US007810257B2

(12) United States Patent
Candrian et al.

(10) Patent No.: US 7,810,257 B2
(45) Date of Patent: Oct. 12, 2010

(54) ARTICLE OF FOOTWEAR WITH REMOVABLE UPPER

(75) Inventors: Natalie Candrian, Portland, OR (US); Michael Steszyn, Porland, OR (US); Charles Kraeuter, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 813 days.

(21) Appl. No.: 11/751,168

(22) Filed: May 21, 2007

(65) Prior Publication Data

US 2008/0289222 A1 Nov. 27, 2008

(51) Int. Cl.
*A43B 3/12* (2006.01)

(52) U.S. Cl. ..... 36/100; 36/101; 36/15

(58) Field of Classification Search ..... 36/15, 36/45, 100, 101
See application file for complete search history.

(56) References Cited

U.S. PATENT DOCUMENTS

| | | | | |
|---|---|---|---|---|
| 294,174 | A | 2/1884 | Williams | |
| 1,041,185 | A | 10/1912 | Spitz et al. | |
| 1,803,554 | A | 5/1931 | Knilans | |
| 1,888,862 | A | 11/1932 | Mathews | |
| 1,907,997 | A | 5/1933 | Nickerson | |
| 2,112,613 | A | 3/1938 | Waxelbaum | 36/11.5 |
| 2,147,197 | A | 2/1939 | Glidden | 36/9 |
| 2,151,341 | A | 3/1939 | Vestergren | 36/36 |
| 2,183,277 | A * | 12/1939 | Heilhecker | 36/14 |
| 2,368,314 | A | 1/1945 | Marx | 36/11.5 |
| 2,438,711 | A | 3/1948 | Leach et al. | 36/2.5 |
| 2,495,984 | A | 1/1950 | Roy | 36/15 |
| 2,761,224 | A | 9/1956 | Gardiner | 36/11.5 |
| 2,878,595 | A | 3/1959 | Auber | 36/36 |
| 3,016,630 | A * | 1/1962 | Twiggs, Jr. | 36/101 |
| 3,538,628 | A | 11/1970 | Einstein, Jr. | 36/15 |
| 4,103,440 | A | 8/1978 | Lawrence | 36/101 |
| 4,377,042 | A | 3/1983 | Bauer | 36/101 |
| 4,420,894 | A | 12/1983 | Glassman | 36/12 |
| 4,447,967 | A | 5/1984 | Zaino | 36/45 |
| 4,606,139 | A | 8/1986 | Silver | 36/15 |
| 4,887,369 | A | 12/1989 | Bailey et al. | 36/101 |
| 5,083,385 | A | 1/1992 | Halford | 36/101 |
| 5,243,772 | A | 9/1993 | Francis et al. | 36/114 |
| 5,317,822 | A | 6/1994 | Johnson | 36/101 |
| 5,339,543 | A * | 8/1994 | Lin | 36/101 |
| 5,353,522 | A | 10/1994 | Wagner | 36/15 |
| D384,495 | S | 10/1997 | Watson | D2/916 |
| 5,822,888 | A | 10/1998 | Terry | 36/100 |
| D409,366 | S | 5/1999 | Duggan | D2/972 |
| 5,983,528 | A | 11/1999 | Hartung | 36/15 |
| 6,345,454 | B1 | 2/2002 | Cotton | 36/101 |
| 6,418,643 | B1 * | 7/2002 | Yang | 36/101 |

(Continued)

*Primary Examiner*—Marie Patterson
(74) *Attorney, Agent, or Firm*—Banner & Witcoff, Ltd.

(57) ABSTRACT

An article of footwear includes a sole assembly having a midsole having an upper surface, a frame recess and a first registration recess being formed in the upper surface. A frame member is seated in the frame recess, and has a first end secured to the midsole, a second end free of the midsole, and a first registration member extending downwardly from a lower surface of the frame member. The first registration member is received in the first registration recess. An upper is removably attached to the sole assembly, and has a pocket on a bottom surface thereof, with the second end of the frame member being received in the pocket.

21 Claims, 2 Drawing Sheets

U.S. PATENT DOCUMENTS

2002/0174569 A1* 11/2002 Tsai ..... 36/101
2008/0229615 A1* 9/2008 Yu ..... 36/100
2008/0271343 A1* 11/2008 Ordenes Haag ..... 36/101

* cited by examiner

ARTICLE OF FOOTWEAR WITH REMOVABLE UPPER

FIELD OF THE INVENTION

This invention relates generally to footwear, and, in particular, to an article of footwear with a removable upper.

BACKGROUND OF THE INVENTION

Conventional articles of athletic footwear include two primary elements, an upper and a sole structure. The upper provides a covering for the foot that comfortably receives and securely positions the foot with respect to the sole structure. In addition, the upper may have a configuration that protects the foot and provides ventilation, thereby cooling the foot and removing perspiration. The sole structure is secured to a lower portion of the upper and is generally positioned between the foot and the ground. In addition to attenuating ground reaction forces, the sole structure may provide traction, control foot motions (e.g., by resisting over pronation), and impart stability, for example. Accordingly, the upper and the sole structure operate cooperatively to provide a comfortable structure that is suited for a wide variety of activities, such as walking and running.

The sole structure generally incorporates multiple layers that are conventionally referred to as an insole, a midsole, and an outsole. The insole is a thin, compressible member located within the upper and adjacent to a plantar (i.e., lower) surface of the foot to enhance footwear comfort. The midsole, which is conventionally secured to the upper along the length of the upper, forms a middle layer of the sole structure and is primarily responsible for attenuating ground reaction forces. The outsole forms the ground-contacting element of footwear and is usually fashioned from a durable, wear-resistant material that includes texturing to improve traction.

The conventional midsole is primarily formed from a resilient, polymer foam material, such as polyurethane or ethylvinylacetate, that extends throughout the length of the footwear. The properties of the polymer foam material in the midsole are primarily dependent upon factors that include the dimensional configuration of the midsole and the specific characteristics of the material selected for the polymer foam, including the density of the polymer foam material. By varying these factors throughout the midsole, the relative stiffness and degree of ground reaction force attenuation may be altered to meet the specific demands of the activity for which the footwear is intended to be used. In addition to polymer foam materials, conventional midsoles may include, for example, one or more fluid-filled bladders and moderators.

It would be desirable to provide an upper for an article of footwear that is removable. A removable upper would provide a user with aesthetic benefits, allowing the user to replace the upper with an upper of a different color or style. This also would allow the user to have a different upper to accommodate different conditions, e.g., using an open mesh upper for summer activities and a solid material upper for colder weather. A removable upper would also be beneficial to allow the user to replace a worn upper. Additionally, having the upper be removable would allow the user to wash the upper if it were to become soiled.

It would also be desirable to provide an article of footwear with a removable upper that reduces or overcomes some or all of the difficulties inherent in prior known devices. Particular objects and advantages will be apparent to those skilled in the art, that is, those who are knowledgeable or experienced in this field of technology, in view of the following disclosure of the invention and detailed description of certain embodiments.

SUMMARY

The principles of the invention may be used to advantage to provide an article of footwear with a removable upper. In accordance with a first aspect, an article of footwear includes a sole assembly having a midsole with an upper surface, a frame recess and a first registration recess being formed in the upper surface. A frame member is seated in the frame recess, and has a first end secured to the midsole, a second end free of the midsole, and a first registration member extending downwardly from a lower surface of the frame member. The first registration member is received in the first registration recess. An upper is removably attached to the sole assembly, and has a pocket on a bottom surface thereof, with the second end of the frame member being received in the pocket In accordance with another aspect, an article of footwear includes a sole assembly with a midsole having an upper surface, a frame recess, a first registration recess, and at least one cap registration being formed in the upper surface. A frame member is seated in the frame recess, and has a first end secured to the midsole, a second end free of the midsole, and a first registration member extending downwardly from a lower surface of the frame member. The first registration member is received in the first registration recess. A heel counter has at least one aperture formed therein. An upper is removably attached to the sole assembly, and has a pocket on a bottom surface thereof. The second end of the frame member is received in the pocket, and has at least one heel projection on a heel portion thereof. Each heel projection is received in a corresponding aperture in the heel counter. A forefoot cap covers a portion of a forefoot region of the upper and has at least one projection on a lower surface thereof. Each projection is received in a corresponding cap registration recess.

In accordance with a further aspect, an article of footwear has a sole assembly including a midsole having an upper surface, a frame recess, a first registration recess, and at least one cap registration being formed in the upper surface. A frame member including a substantially U-shaped member having a first arm and a second arm is seated in the frame recess, with a first end formed of ends of the first and second arms secured to the midsole. A second end is free of the midsole. A first registration member extends downwardly from a lower surface of the frame member. The first registration member is received in the first registration recess. A heel counter has at least one aperture formed therein. An ankle strap has a lateral portion and a medial portion, with each portion extending upwardly from the heel counter. A midfoot strap has a lateral portion and a medial portion, with each portion extending upwardly from the heel counter. An outsole is secured to a lower surface of the midsole. An upper is removably attached to the sole assembly and has a pocket on a bottom surface thereof. The second end of the frame member is received in the pocket. At least one heel projection formed on a heel portion of the upper. Each heel projection is received in a corresponding aperture in the heel counter. A forefoot cap covers a portion of a forefoot region of the upper and has at least one projection on a lower surface thereof. Each projection is received in a corresponding cap registration recess.

Substantial advantage is achieved by providing an article of footwear with a removable upper. In particular, certain embodiments would provide users with aesthetic benefits, for example, allowing the user to replace the upper with an upper of a different color or style. The user could have different uppers to accommodate different environmental conditions, for example.

These and additional features and advantages disclosed here will be further understood from the following detailed disclosure of certain embodiments.

Figure 1:
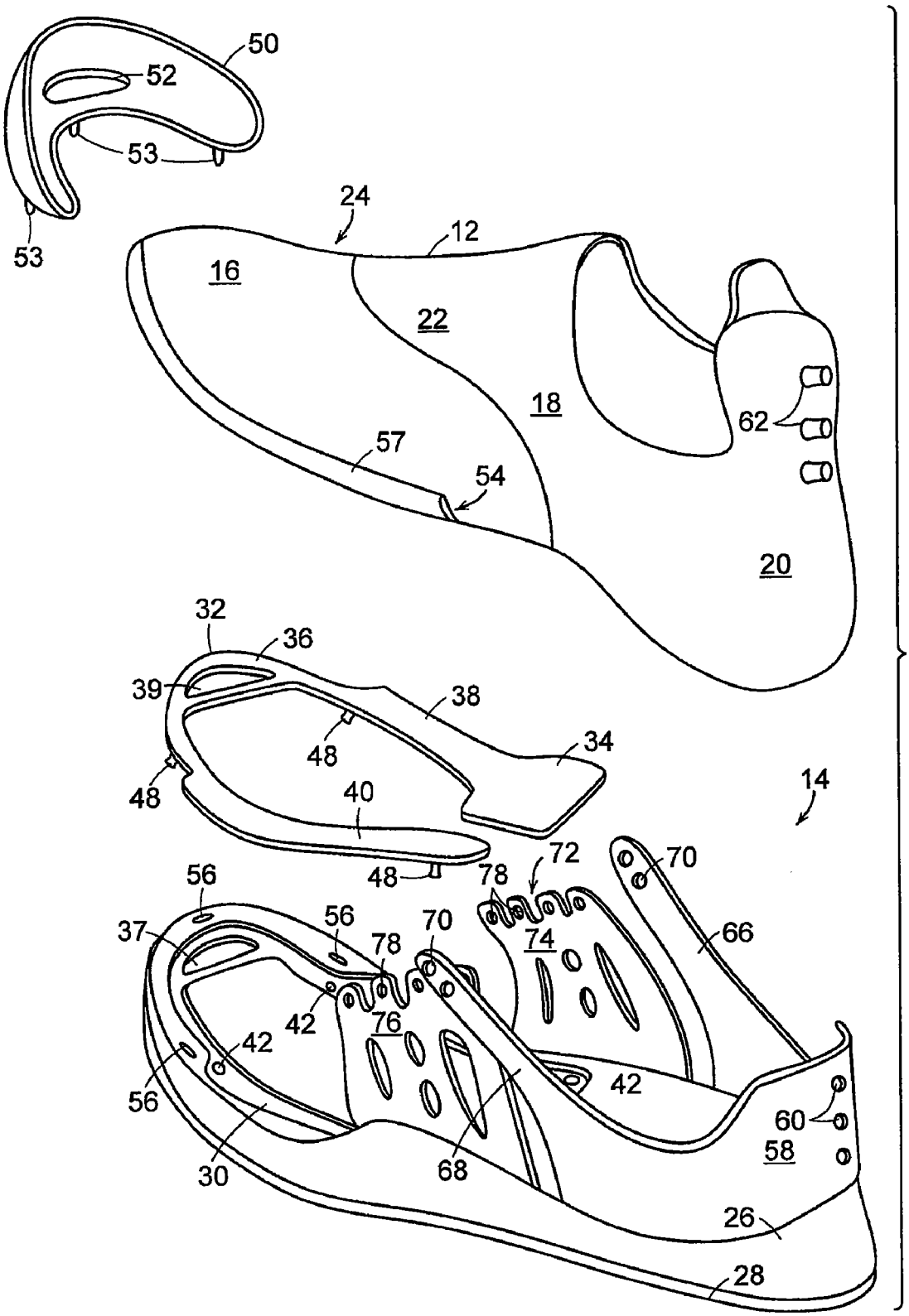
FIG. 1 is a perspective view in exploded form of an article of footwear with a removable upper.

The figures referred to above are not drawn necessarily to scale, should be understood to provide a representation of particular embodiments of the invention, and are merely conceptual in nature and illustrative of the principles involved. Some features of the article of footwear with a removable sole depicted in the drawings have been enlarged or distorted relative to others to facilitate explanation and understanding. The same reference numbers are used in the drawings for similar or identical components and features shown in various alternative embodiments. Articles of footwear with a removable sole as disclosed herein would have configurations and components determined, in part, by the intended application and environment in which they are used.

DETAILED DESCRIPTION OF CERTAIN PREFERRED EMBODIMENTS

The following discussion and accompanying figures disclose an article of footwear 10 in accordance with aspects of the present invention. Footwear 10 is depicted in the figures and discussed below as having a configuration that is suitable for athletic activities, particularly running. The concepts disclosed with respect to footwear 10 may, however, be applied to footwear styles that are specifically designed for a wide range of other athletic activities, including basketball, baseball, football, soccer, walking, and hiking, for example, and may also be applied to various non-athletic footwear styles, including dress shoes, loafers, sandals, and work boots. Accordingly, one skilled in the relevant art will recognize that the concepts disclosed herein may be applied to a wide range of footwear styles and are not limited to the specific embodiments discussed below and depicted in the figures.

Footwear 10 is depicted in FIG. 1 in exploded form and includes an upper 12 and a sole assembly 14. For purposes of reference, footwear 10 may be divided into three general regions: a forefoot region 16, a midfoot region 18, and a heel region 20, as defined in FIG. 1. Forefoot region 16 generally includes portions of footwear 10 corresponding with the toes and the joints connecting the metatarsals with the phalanges. Midfoot region 18 generally includes portions of footwear 10 corresponding with the arch area of the foot, and heel region 20 corresponds with rear portions of the foot, including the calcaneus bone. Footwear 10 also includes a medial side 22 and an opposite lateral side 24. Medial side 22 and lateral side 24 extend through each of regions 16-20 and correspond with opposite sides of footwear 10.

Regions 16-20 and sides 22-24 are not intended to demarcate precise areas of footwear 10. Rather, regions 16-20 and sides 22-24 are intended to represent general areas of footwear 10 that provide a frame of reference during the following discussion. Although regions 16-20 and sides 22-24 apply generally to footwear 10, references to regions 16-20 and sides 22-24 may also apply specifically to upper 12, sole assembly 14, or an individual component or portion within either of upper 12 or sole assembly 14, or any other component of footwear 10.

Unless otherwise stated, or otherwise clear from the context below, directional terms used herein, such as rearwardly, forwardly, inwardly, downwardly, upwardly, etc., refer to directions relative to footwear 10 itself. Footwear 10 is shown in FIG. 1 to be disposed substantially horizontally, as it would be positioned on a horizontal surface when worn by a wearer. However, it is to be appreciated that footwear 10 need not be limited to such an orientation. Thus, in the illustrated embodiment of FIG. 1, rearwardly is toward heel portion 20, that is, to the right as seen in FIG. 1. Naturally, forwardly is toward forefoot portion 16, that is, to the left as seen in FIG. 1, and downwardly is toward the bottom of the page as seen in FIG. 1. Inwardly is toward the center of footwear 10, and outwardly is toward the outer peripheral edge of footwear 10.

Upper 12 is formed from various material elements that are stitched or adhesively-bonded together to form an interior void that comfortably receives a foot and secures the position of the foot relative to sole assembly 14. A variety of materials are suitable for upper 12, including the materials that are conventionally utilized in footwear uppers. Accordingly, upper 12 may be formed from combinations of leather, synthetic leather, natural or synthetic textiles, polymer sheets, polymer foams, mesh textiles, felts, non-woven polymers, or rubber materials, for example. The interior of upper 12 may have foam elements for enhancing the comfort of footwear 10, and the interior surface may include a moisture-wicking textile for removing excess moisture from the area immediately surrounding the foot.

Sole assembly 14, which is generally disposed between the foot of the wearer and the ground, provides attenuation of ground reaction forces (i.e., imparting cushioning), traction, and may control foot motions, such as pronation. As with conventional articles of footwear, sole assembly 14 includes an insole (not shown) located within upper 12, a midsole 26, and an outsole 28. Midsole 26 is removably attached to upper 22 and functions as the primary shock-attenuating and energy-absorbing component of footwear 10. Suitable materials for midsole 26 are any of the conventional polymer foams that are utilized in footwear midsoles, including ethylvinylacetate and polyurethane foam.

Outsole 28 is secured to a lower surface of midsole 26 to provide wear-resistance. In addition, outsole 28 may be textured to enhance the traction (e.g., friction) properties between footwear 10 and the ground. Suitable materials for outsole 28 include any of the conventional rubber materials that are utilized in footwear outsoles, such as carbon black rubber compound. Other suitable materials for outsole 28 will become readily apparent to those skilled in the art, given the benefit of this disclosure.

As noted above, upper 12 is advantageously removably secured to sole assembly 14, allowing the user to replace upper 12 if it is worn, for example. Additionally, having a removable upper allows the user to substitute another upper 12 having a different color or other attributes for aesthetic or functional reasons. For example, in warmer weather the user could install an upper with a more open, e.g., mesh, construction, while in colder weather a closed upper, and possibly one with insulative materials, could be used.

A frame recess 30 is formed in an upper surface of midsole 26. A frame member 32 is seated in frame recess 30. A first end 34 of frame member 32 is secured to midsole 26 within frame recess 30 in midfoot portion 18 of midsole 26, while a second end 36 of frame member 32 is free to move upwardly out of frame recess 30 proximate forefoot portion 16 of midsole 26. Frame member 32 may be formed of an elastomer material, for example, such as thermoplastic polyurethane (TPU).

In the illustrated embodiment, frame member 32 is a substantially U-shaped member having a first arm 38 and a second arm 40, with first arm 38 extending rearwardly along lateral side 24 of midsole 26 in frame recess 30 and second arm 40 extending rearwardly along medial side 22 of midsole 26 in frame recess 30. Thus, the open end of U-shaped frame member 32 faces heel portion 20 such that ends of first arm 38 and second arm 40 form first end 34 of frame member 32. Naturally, the closed end of U-shaped frame member 32 is in forefoot region 16 of midsole 26 and forms second end 36 of frame member 32. First end 34 of frame member 32 may be secured with adhesive or other suitable fastening means within frame recess 30.

A first registration recess 37 is formed in forefoot region of midsole 26, slightly forward of frame recess 30. A first registration member 39 extends downwardly from a lower surface of the forefoot region 16 of frame member 32 and is seated in first registration recess 37, helping to align and register frame member 32 with respect to midsole 26.

A plurality of second registration recesses 42 is formed in midsole 26, each of which receives a corresponding second registration member 48 extending downwardly from a bottom surface of frame member 32. In certain embodiments two second registration members 48 are formed on first arm 38 of frame member 32 and two second registration members 48 are formed on second arm 40 of frame member 32. In the illustrated embodiment, one second registration member 48 is positioned in forefoot region 16 of each of first arm 38 and second arm 40 proximate the closed end of frame member 32, and one second registration member 48 is positioned proximate the end of each of first arm 38 and second arm 40, with second registration recesses 42 positioned in corresponding locations in midsole 26 (not all are visible in FIG. 1).

In the illustrated embodiment, second registration members 48 are posts with bulbous ends, which are received in snap-fit fashion in second registration recesses 42. It is to be appreciated that second registration members 48 and second registration recesses 42 may have other shapes, and that other such suitable shapes will become readily apparent to those skilled in the art, given the benefit of this disclosure.

Figure 2:
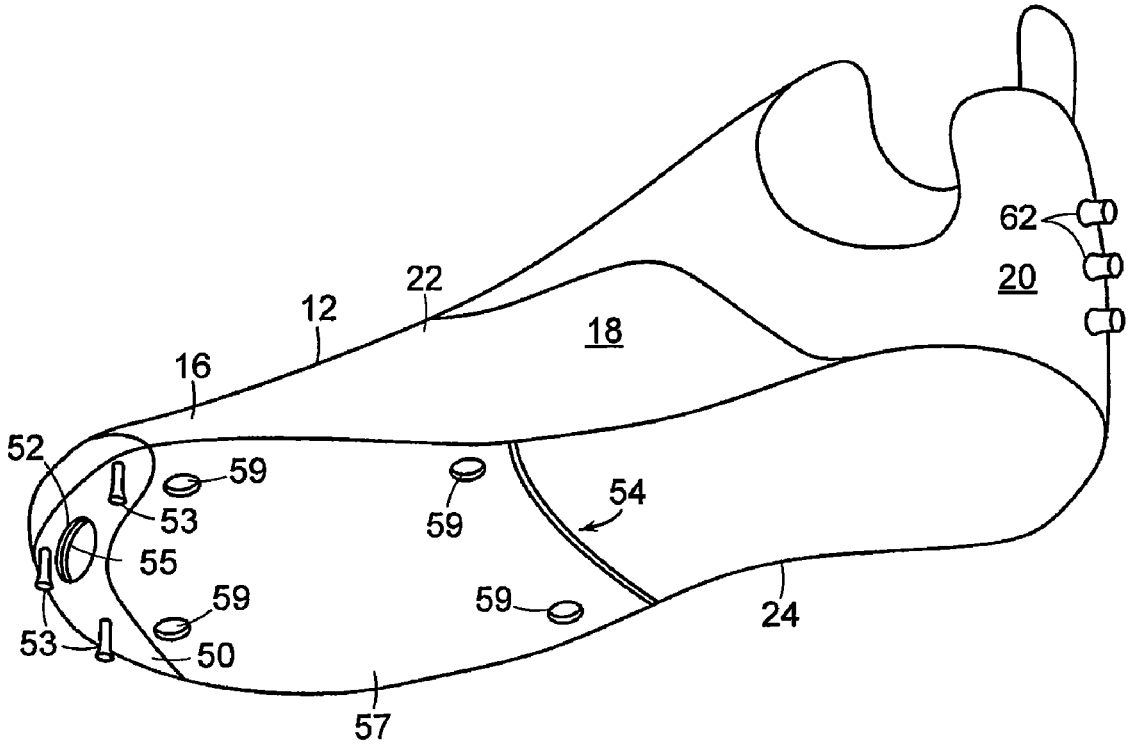
FIG. 2 is a perspective view of the bottom of the removable upper of the article of footwear of FIG. 1.

A forefoot cap 50 is secured to forefoot region 16 of upper 12 by adhesive or other suitable fastening means. A cap aperture 52 is formed in a lower surface of forefoot cap 50, as seen in FIG. 2. Forefoot cap 50 may be formed of a rigid material, such as TPU, or a polyether block copolyamide (sold as Pebax® by ATOFINA Chemicals of Philadelphia, Pa.). Cap projections 53 are formed on the lower surface of forefoot cap 50 about its periphery. Cap projections 53 are releasably received in mating cap registration recesses 56 formed in the forefoot region 16 of midsole 26. In the illustrated embodiment, three cap projections 53 are formed on forefoot cap 50 and three mating cap registration recesses 56 are formed in midsole 26. The mating of cap projections 53 and cap registration recesses 56 further helps to register upper 12 with respect to midsole 26.

A pocket 54 is formed in the midfoot portion 18 and forefoot portion 16 of the lower surface of upper 12. Pocket 54 is configured to receive second end 36 of frame member 30. First registration member 39 of frame member 30 extends downwardly through a first aperture 55 formed in pocket 54 and cap aperture 52 when frame member 30 is inserted into pocket 54, and is then seated in first registration recess 37, thereby helping register upper 12 with respect to midsole 26. Similarly, a plurality of second apertures 59 is formed in pocket 54, with each second registration member 48 extending downwardly through one of the second apertures 59 into a corresponding second registration recess 42.

In certain embodiments, pocket 54 is formed by positioning a piece of material 57 beneath the midfoot region 18 and forefoot region 16 of upper 12, and securing material 57 along its lateral and medial edges to upper 12. Material 57 may be secured to upper 12 with adhesive, stitching or any other suitable fastening means. Material 57 may be TPU, for example. Other suitable materials will become readily apparent to those skilled in the art, given the benefit of this disclosure.

A heel counter 58 extends upwardly from heel portion 20 of midsole 26. A plurality of apertures 60 is formed in heel counter 58, with each aperture receiving a mating upper projection 62 formed on the rear surface of heel portion 20 of upper 12. The engagement of upper projections 62 and apertures 60 helps to removably secure upper 12 to sole assembly 14.

An ankle strap 64 has a lateral portion 66 and a medial portion 68 extending upwardly and forwardly from heel counter 58. One or more eyelets 70 are formed in the ends of lateral portion 66 and medial portion 68 to receive laces (not shown). Ankle strap 64 extends about the ankle of the user, helping to retain the user's foot within footwear 10.

A midfoot strap 72 has a lateral portion 74 and a medial portion 76 extending upwardly from midsole 26. A plurality of eyelets 78 is formed in each of lateral portion 74 and medial portion 76 to receive the laces (not shown). Midfoot strap 72 extends about the midfoot of the user, helping to retain the user's foot within footwear 10.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. An article of footwear comprising, in combination:

a sole assembly comprising:

a midsole having an upper surface, a frame recess and a first registration recess being formed in the upper surface; and a frame member seated in the frame recess, having a first end secured to the midsole, a second end free of the midsole, and a first registration member extending downwardly from a lower surface of the frame member, the first registration member being received in the first registration recess; and an upper removably attached to the sole assembly, having a pocket on a bottom surface thereof, the second end of the frame member being received in the pocket.

2. The article of footwear of claim 1, wherein the first registration recess is formed in a forefoot region of the midsole.

3. The article of footwear of claim 1, wherein the sole assembly further comprises a heel counter having at least one aperture formed therein, and the upper includes at least one heel projection on a heel portion thereof, each heel projection on the upper being received in a corresponding aperture in the heel counter.

4. The article of footwear of claim 1, further comprising:

at least one cap registration recess formed in an upper surface of the midsole; and a forefoot cap covering a portion of a forefoot region of the upper and having at least one projection on a lower surface thereof, each projection being received in a corresponding cap registration recess.

5. The article of footwear of claim 1, further comprising a piece of material secured beneath the upper to form the pocket.

6. The article of footwear of claim 1, wherein the frame member comprises a substantially U-shaped member having a first arm and a second arm, ends of the first and second arm forming the first end of the frame member.

7. The article of footwear of claim 6, wherein each of the first and second arm includes a second registration member that is received in a corresponding second registration recess formed in the midsole.

8. The article of footwear of claim 1, wherein the sole assembly further comprises an ankle strap having an upwardly extending lateral portion and an upwardly extending medial portion.

9. The article of footwear of claim 8, wherein each of the lateral and medial portions includes an eyelet.

10. The article of footwear of claim 1, wherein the sole assembly further comprises a midfoot strap having an upwardly extending lateral portion and an upwardly extending medial portion.

11. The article of footwear of claim 10, wherein each of the lateral and medial portions includes an eyelet.

12. The article of footwear of claim 1, wherein the sole assembly further comprises an outsole secured to a lower surface of the midsole.

13. An article of footwear comprising, in combination:

a sole assembly comprising:

a midsole having an upper surface, a frame recess, a first registration recess, and at least one cap registration being formed in the upper surface;

a frame member seated in the frame recess, having a first end secured to the midsole, a second end free of the midsole, and a first registration member extending downwardly from a lower surface of the frame member, the first registration member being received in the first registration recess; and a heel counter having at least one aperture formed therein;

an upper removably attached to the sole assembly, having a pocket on a bottom surface thereof, the second end of the frame member being received in the pocket, and at least one heel projection on a heel portion thereof, each heel projection being received in a corresponding aperture in the heel counter; and a forefoot cap covering a portion of a forefoot region of the upper and having at least one projection on a lower surface thereof, each projection being received in a corresponding cap registration recess.

14. The article of footwear of claim 13, wherein the frame member comprises a substantially U-shaped member having a first arm and a second arm, ends of the first and second arm forming the first end of the frame member.

15. The article of footwear of claim 14, wherein each of the first and second arm includes a second registration member that is received in a corresponding second registration recess formed in the midsole.

16. The article of footwear of claim 13, wherein the sole assembly further comprises an ankle strap having an upwardly extending lateral portion and an upwardly extending medial portion.

17. The article of footwear of claim 16, wherein each of the lateral and medial portions includes an eyelet.

18. The article of footwear of claim 13, wherein the sole assembly further comprises a midfoot strap having an upwardly extending lateral portion and an upwardly extending medial portion.

19. The article of footwear of claim 18, wherein each of the lateral and medial portions includes an eyelet.

20. The article of footwear of claim 13, wherein the sole assembly further comprises an outsole secured to a lower surface of the midsole.

21. An article of footwear comprising, in combination:

a sole assembly comprising:

a midsole having an upper surface, a frame recess, a first registration recess, and at least one cap registration being formed in the upper surface;

a frame member comprising a substantially U-shaped member having a first arm and a second arm is seated in the frame recess, having a first end formed of ends of the first and second arms secured to the midsole, a second end free of the midsole, and a first registration member extending downwardly from a lower surface of the frame member, the first registration member being received in the first registration recess;

a heel counter having at least one aperture formed therein;

an ankle strap having a lateral portion and a medial portion, each portion extending upwardly from the heel counter;

a midfoot strap having a lateral portion and a medial portion, each portion extending upwardly from the heel counter; and an outsole secured to a lower surface of the midsole;

an upper removably attached to the sole assembly, having a pocket on a bottom surface thereof, the second end of the frame member being received in the pocket, and at least one heel projection on a heel portion thereof, each heel projection being received in a corresponding aperture in the heel counter; and a forefoot cap covering a portion of a forefoot region of the upper and having at least one projection on a lower surface thereof, each projection being received in a corresponding cap registration recess.

* * * * *